United States Patent [19]

Parker et al.

[11] Patent Number: 4,881,947

[45] Date of Patent: Nov. 21, 1989

[54] HIGH EFFICIENCY GASIFIER WITH RECYCLE SYSTEM

[76] Inventors: Thomas H. Parker, Depot St., P.O. Box 58, Richford, N.Y. 13835; Virgil J. Flanigan, Route 5, Box 629, Rolla, Mo. 65401

[21] Appl. No.: 212,519

[22] Filed: Jun. 28, 1988

[51] Int. Cl.[4] ..... C10B 1/10

[52] U.S. Cl. ..... 48/89; 48/111; 202/118; 202/136; 202/218; 432/114

[58] Field of Search ..... 48/89, 111; 202/108, 202/109, 117, 118, 131, 136, 137, 138, 218; 432/103, 107, 114, 106; 34/129, 131, 138; 165/88; 110/246

[56] References Cited

U.S. PATENT DOCUMENTS

| | | | |
|---|---|---|---|
| 3,401,923 | 9/1968 | Bearce | 34/129 |
| 3,607,121 | 9/1971 | Watson et al. | 34/129 |
| 3,787,292 | 1/1974 | Keappler | 202/136 |
| 4,589,354 | 5/1986 | Faehnle | 202/136 |

*Primary Examiner*—Joye Woodard

*Attorney, Agent, or Firm*—D. A. N. Chase; Joan Optican Herman

[57] ABSTRACT

A high efficiency gasifier employs a rotary kiln having an indirect fired gasifier and a recycle system. The rotary kiln provides an essentially oxygen-free gasifying chamber into which raw feed material is introduced. Radiant tubes within the chamber transfer heat to the incoming raw feed material to pyrolyze it and convert it to char and product gas as the material advances toward the outlet end. The recycle system within the chamber returns both product gas and hot char to a receiving end of the kiln to aid in heat transfer to the raw feed material. The feed is thus heated more rapidly, and less heat input is required. Efficiency is further aided by providing additional residence time and gasification of the char.

3 Claims, 2 Drawing Sheets

HIGH EFFICIENCY GASIFIER WITH RECYCLE SYSTEM

BACKGROUND OF THE INVENTION

This invention relates to the conversion of organic solid waste materials, such as wood, rubber, sewer sludge, agricultural residues, refuse derived fuel and hazardous waste, into a more usable form including medium BTU gas, high energy chars and condensible oils. More particularly, this invention relates to the pyrolysis and gasification of a feed material in an indirect fired self-sustaining rotary kiln reactor provided with an internal recycle system to enhance the conversion processes.

Several different methods are available for the thermochemical treatment of waste products, including various combustion gasification and pyrolysis processes. One such gasification process utilizes an indirect fired rotary kiln in which carbonaceous waste materials are gasified by pyrolysis and classical carbon, hydrogen and oxygen chemistry. Pyrolysis is the high temperature chemical decomposition of the waste material in an oxygen free environment producing solid, liquid and gaseous products. The carbon, hydrogen and oxygen work to modify the conversion fractions of the resulting components. The principle reactions are the steam char reactions, brodeaux reactions, and the water gas shift reactions. These reactions work to convert the resulting char to gas, and to produce higher hydrogen concentrations.

The alkalai elements in the ash catalyze these reactions, driving the products toward more gas and less solids. Increases in the residence time will also aid in increased gas production and reduced char values.

The pyrolysis process results by providing a high temperature reaction chamber where each feed particle is heated rapidly to destruction. The chamber is the rotary kiln and the heat source is radiant tubes mounted in the reactor. The radiant tubes are fired with part of the gas produced which is supplied by bringing cleaned product gas on board the reactor. The feed material is supplied to one end of the reactor, and the forces of gravity provide the material flow of the solids to the outlet end.

The system design provides for good energy utilization since the flow of solids is counter to the flow of gas in the radiant tubes. However, the percentage of gas used to heat the reactions and the residual char levels can be high. To improve these operating characteristics, the present invention adds several features to the rotary kiln design. An internal recycle system is provided to return part of the char produced to the fuel end of the reactor. The recycling of the char (carbon and ash) increases the char residence time in the reactor permitting increased time for conversion to gas. At the same time the char fraction in the reactor is increased, increasing the carbon and ash concentration at any point in the reactor. The increased catalytic ash content together with the increased carbon concentration drive the reactions' products toward more gas and less solids, while the increased carbon concentrations also drive the reaction products toward gas.

These conversions are further aided by the increased temperature at the cold end resulting from mixing the hot, recycled char with the incoming feed. These higher temperatures also result in a better conversion to gas, while reducing the amount of gas required for the radiant tubes to thereby improve efficiency.

Another feature which aids in gas production is the reduction of the condensible gas fraction in the product gas. This is accomplished by recycling part of the produced gas to increase the gas residence time, and at the same time transferring a portion of the sensible energy of the hot gas to the raw feed to increase the heating rate in the reactor. The gas recycle means extends through the center recycle tube, aiding the solid recycle by helping to increase the velocity component of the solid particles and permitting further reactions within the recycle housing.

In summary, the gas and char recycle system aids in reducing these components while increasing the product gas fraction. The recycle system also conserves valuable energy by reducing the product gas requirements for the burners and reduces the heating length in the reactor favoring faster and more complete gasification.

OBJECTS OF THE INVENTION

It is, therefore, an object of the present invention to provide a self-sustaining indirect fired gasifier with improved gasification efficiency.

It is a further object of the present invention to provide an indirect fired gasifier with an internal recycle system which increases the residence time of the char, resulting in increased ash and carbon concentrations at any point in the reactor, thereby reducing char yields while increasing gas production.

It is another object of the present invention to provide an indirect fired gasifier wherein the recycle system aids in rapidly heating by mixing with the incoming feed, shortening the initial heating length and conserving valuable product gas used in the burners.

It is another object of the present invention to provide an indirect fired gasifier wherein the gasification system utilizes a portion of the product gas to be recycled to increase the efficiency of the gasifier by reducing the tar yields and by conserving valuable sensible heat to heat the feed material.

It is yet another object of the present invention to provide an indirect fired gasifier of the rotary kiln type with inserted radiant heat transfer tubes, wherein the rotary kiln has a conical configuration to focus the radiant energy of the tubes toward the heat load of the cold raw material entering the gasifier.

It is still a further object of the present invention to provide the conical configuration as described above whereby a maximum feed flux rate of the raw material and recycled material is achieved by taking advantage of the significant volume and mass reduction of the solid material as the process occurs along the reactor axis.

Other objects and advantages of this invention will become apparent from the following description taken in connection with the accompanying drawings, wherein is set forth by way of illustration and example, an embodiment of this invention.

DETAILED DESCRIPTION OF THE PREFERRED EMBODIMENT

Figure 1:
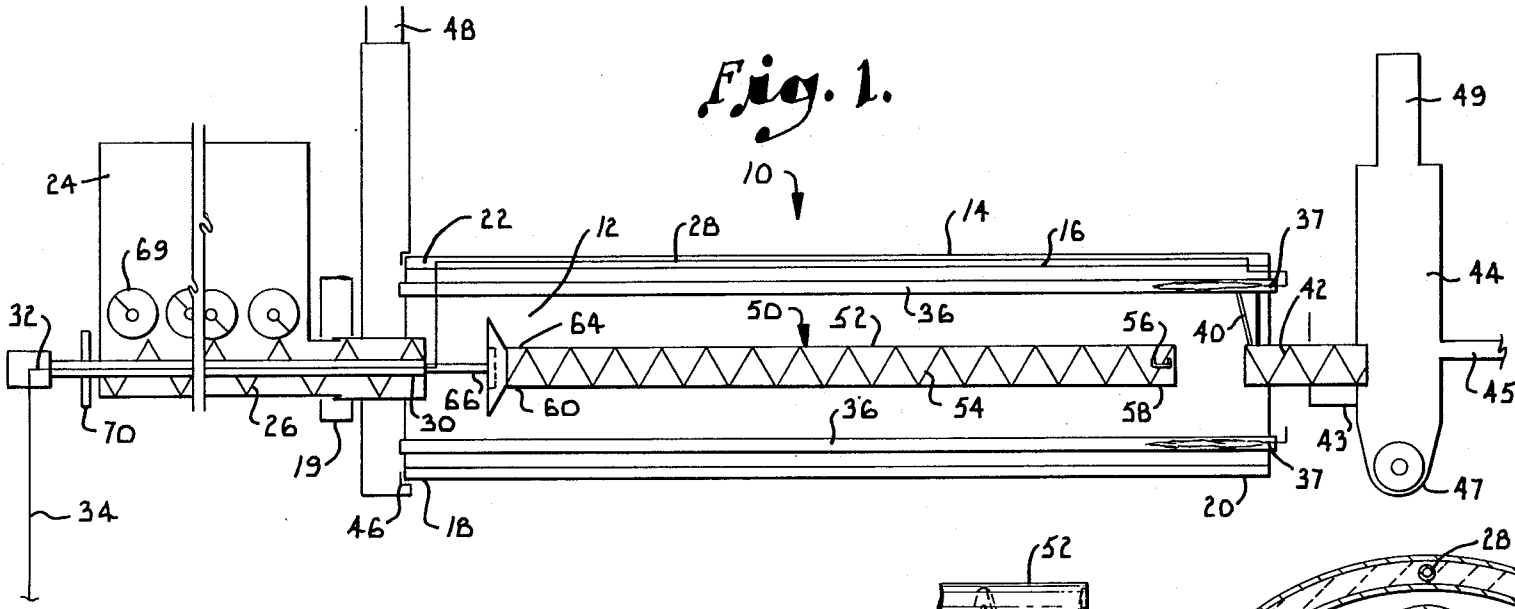
FIG. 1 is a schematic diagram showing an embodiment of the rotary kiln of the present invention having a recycle system.

Referring initially to the generalized illustration in FIG. 1, an indirect fired gasifier is shown which is primarily comprised of a rotary kiln generally referred to as 10. The rotary kiln 10 provides an elongated, cylindrical gasifying chamber 12 which has a horizontally extending longitudinal axis. A circumferential outer wall 14 is radially spaced from the longitudinal axis, and a spaced apart inner wall 16 is also radially spaced from the longitudinal axis and is essentially concentric with the outer wall 14. The chamber 12 is defined therewithin, and is further defined by a receiving end 18 and an outlet end 20. The kiln 10 is rotatably mounted on rollers (not shown), and labyrinth seals 19 and 43 are provided to seal the respective reactor ends and terminate the rotation. The outer wall 14 and the inner wall 16 are separated by the support structure and by an appropriate insulating material 22. The rotary kiln 10 rotates in a counter clockwise direction when viewed from the receiving end 18 toward the outlet end 20. The kiln drive (not shown) is conventional, and may be provided by a circumscribing sprocket engaged by a chain driven by a suitable prime mover.

The feed material used consists of a variety of materials, such as wood, rubber, sewer sludge, refuse derived fuel and agricultural residues. It is introduced into the receiving end 18 of the chamber 12 from a feed bin 24 by a feed auger 26 driven through a chain drive 70.

A gas pipe 28 is located between the outer wall 14 and the inner wall 16. The gas pipe 28 extends through the center of the auger 26 and is connected to a rotating coupling 32 and to a supply pipe 34. The pipe 28 is sealed from the reactor using a packing gland (not shown), and it turns with the reactor. A shaft 66 passes through the gas pipe 28 and drives a recycle fan 64. The drive shaft 66 extends from the rotating coupling 32 and is sealed using another packing gland 67.

The feed is supplied to the reactor by the feed screw 26 driven by a variable drive through sprocket 70. The feed bin 24 contains cross screws 69 to insure an even feed to the feed auger 26. The auger 26 passes through the labyrinth seal 19, which uses carbon from the process to seal the labyrinth path and to insure no leakage to the reactor. The gas pipe 28 passing along the reactor shell feeds a burner manifold (not shown) which in turn feeds a plurality of radiant tubes 36 that are radially spaced from the longitudinal axis of the chamber 12 and extend longitudinally therethrough.

The radiant tubes 36 are heated by the gaseous combustion products of respective burners 37, the heat produced being transferred to the feed material (not shown) in chamber 12. The feed material is thus pyrolyzed and converted essentially to char and product gas. A three-sided outlet dipper 40 located near the outlet end 20 of the chamber 12 unloads the material from the chamber 12 through a right-handed open core outlet auger 42 in response to the rotation of the kiln 10. The outlet auger 42 is rotatably mounted in the labyrinth seal 43. The products are moved into a solid separator 44 which, due to gravity, separates the product gas from the solids, the product gas flowing through outlet 45 and the solids being discharged by a bottom auger 47.

A portion of the product gas is used to drive the burners 37 in a self-sustaining mode. The portion of the gas to be used is cleaned in a conventional manner by passing the gas through a cooler, a demister, a bag house and a compressor (not shown). The cleaned gas enters the rotary kiln 10 via the gas supply line 34 which communicates with the gas line 28 in the center of the feed auger 26. The gas flows through the gas pipe 28 to the burners 37 where it is burned to fire the radiant tubes 36. The exhaust from the combusted gas is collected on the receiving end 18 of the chamber 12 by a stationary exhaust collector 46 supplying the flue 48. A flare 49 on the exit end 20 is used to burn any excess gas and to burn the gas produced during start-up.

A recycle system, generally referred to as 50, comprises a conduit structure 52 extending along the longitudinal axis of and coaxial with the gasifying chamber 12, extending from the receiving end 18 to the outlet end 20. The conduit 52 is rotatable with the kiln 10 and is fitted with a coreless, left-handed auger 54. A three-sided recycle dipper 56 extends radially outwardly from the conduit 52 and is rotatable with the conduit 52, and is located at the receiving end 58 of the conduit 52 to load a portion of the char into the recycle auger 54. The dipper 56 can be designed to be adjustable if desired. As seen is FIGS. 1 and 1*a*, the outlet dipper 40 and the recycle dipper 56 are offset at a 90° angle from each other. Each of the three-sided dippers is open facing the direction in which they are to be rotated in order to achieve a scooping action. A recycle feed port 62 in the conduit 52 at the base of the recycle dipper 56 allows the char to enter the conduit 52. The char is then conveyed through the conduit 52 by the helical flighting of the recycle auger 54 under the influence of gravity in response to the rotation of the kiln 10. The char is moved in this manner to the exit end 60 of the conduit 52 where it is deposited in the receiving end 18 of the chamber 12 and is mixed with the incoming raw feed material.

A recycle fan 64 is mounted in the exit end 60 of the conduit 52. It is driven by a drive shaft 66 through the gas pipe 28 and the rotating coupling 32, and draws hot product gas from the outlet end 20 of the chamber 12 to recycle such gas and augment the recycling of the char and the heating of the incoming feed material, as described in detail below.

Figure 1A:
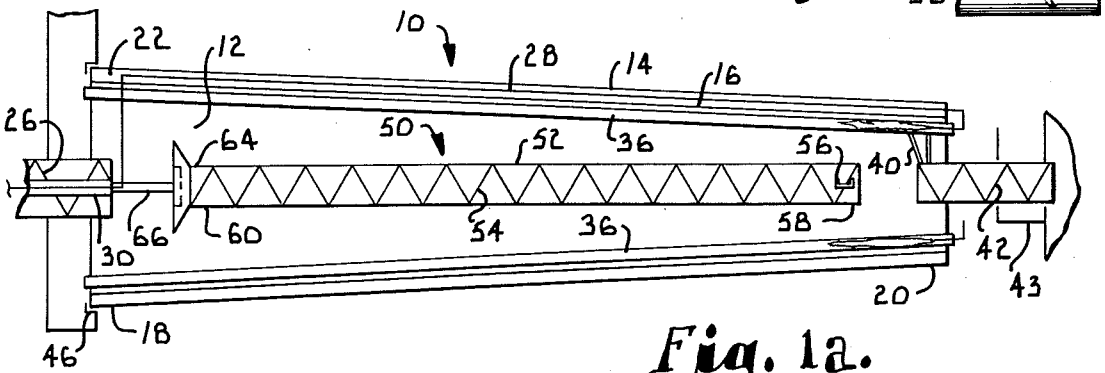
FIG. 1*a* is a schematic diagram showing a conical configuration of the rotary kiln embodying the present invention.

FIG. 1*a* depicts a rotary kiln 10 substantially similar to that depicted in FIG. 1, differing in that the kiln 10 is of a generally conical configuration and provides the gasifying chamber 12 with progressively smaller cross-sectional areas as the outlet end 20 is approached. The radiant tubes 36 are circumferentially spaced extending generally parallel to the outer wall 14 of the chamber, and converge as the outlet end 20 is approached. This conical configuration focuses the radiant energy toward the heat load of the advancing feed material, and thus increases the efficiency of the rotary kiln 10 as described in detail below.

Figure 2:
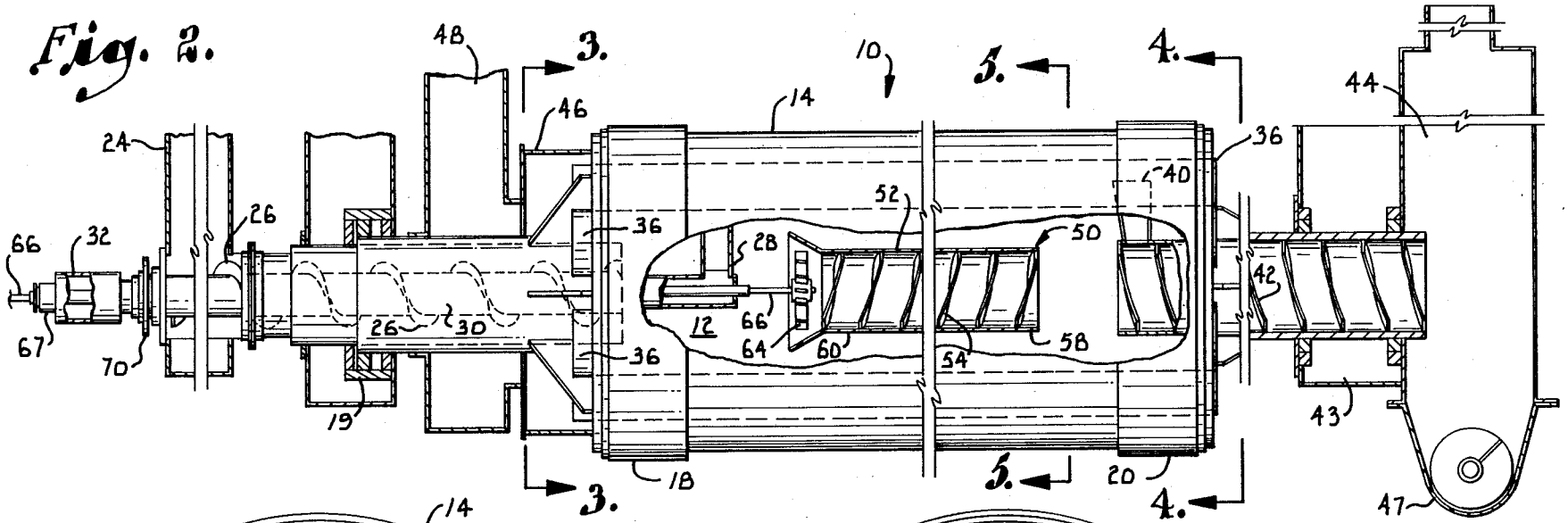
FIG. 2 is a fragmentary diagrammatic and elevational view of the rotary kiln of the present invention with parts broken away to show the recycle system.

A specific preferred construction of the reactor kiln 10 is shown in detail in FIGS. 2–6. Like components bear the same reference numerals as used in the above description of FIG. 1. The tubular conduit structure 52 in FIG. 2 is broken away and revealed in cross-section in order to show the successive flights of the recycle auger 54 and the fan 64.

Figure 3:
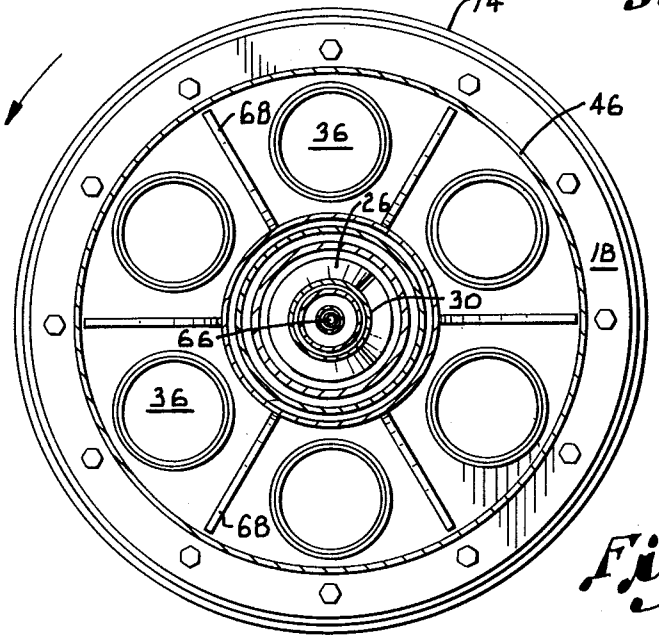
FIG. 3 is an enlarged cross-sectional view taken along line 3—3 of FIG. 2.

Referring now to FIG. 3, a cross-section of the receiving end 18 of the gasifying chamber 12 is depicted. The relative size of the radiant tubes 36 can be seen in relation to the outer wall 14 of the gasifying chamber 12. The counter clock-wise rotation of the rotary kiln 10 is illustrated by the arrow. Radial fins 68 are provided for structural reinforcement of the kiln end. The feed auger 26 is positioned about the gas pipe 28 and moves in a clockwise direction in response to the variable speed drive feeding the raw material into the receiving end 18. The drive shaft 66 extends longitudinally through the gas pipe 28 to drive the recycle fan 64.

Figure 4:
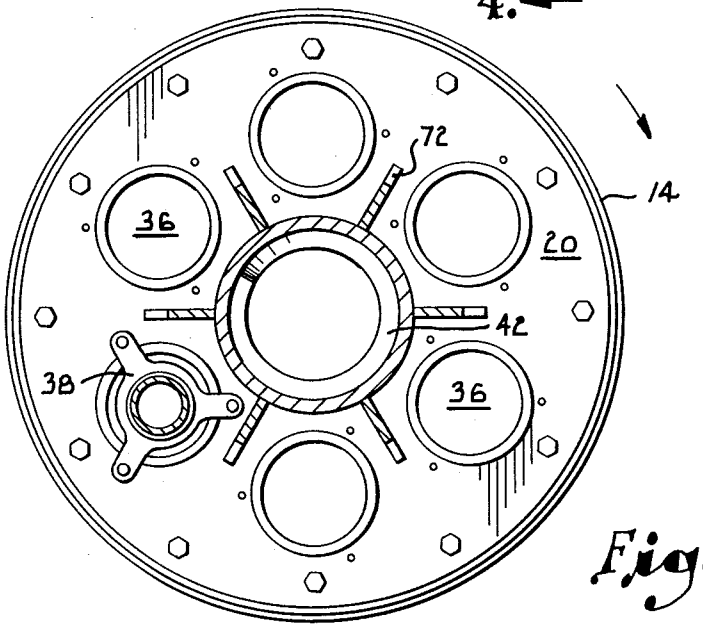
FIG. 4 is an enlarged cross-sectional view taken along line 4—4 of FIG. 2.

The outlet end 20 of the gasifying chamber 12 is shown in cross-section in FIG. 4. The ends of the radiant tubes 36 are each provided with a burner 37 to burn the gas within the radiant tubes 36 and thereby provide radiant heat for the pyrolysis of the feed material. For clarity, one of the burner holders 38 is shown (FIG. 4). The right-handed outlet auger 42 removes char from the gasifying chamber 12 in response to the rotation of the kiln 10. Radial supports 72 are provided to further reinforce the rotary kiln 10.

Figure 6:
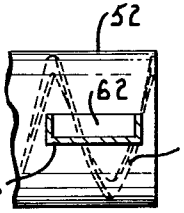
FIG. 6 is a cross-sectional, detail view taken along line 6—6 of FIG. 5 and showing the recycle dipper of the present invention.
Figure 5:
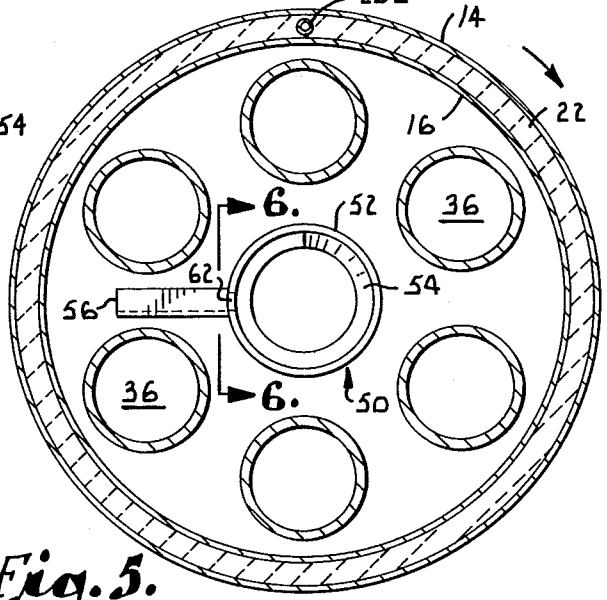
FIG. 5 is an enlarged cross-sectional view taken along line 5—5 of FIG. 2.

Referring now to FIG. 5, a cross-section shows the entrance end 58 of the recycle system 50. Being left-handed, the recycle auger 54 causes the recycled char to move from the outlet end 20 of the gasifier 12 to the receiving end 18 in response to the rotation of the kiln 10. The recycle dipper 56 extends radially outwardly from the recycle conduit structure 52 and is rotatable therewith for loading a portion of the char into the conduit 52 for recycling. By gravity, the scooped char flows through the feed hole 62 as the dipper 56 traverses an arc above the conduit 52. FIG. 6 further depicts the recycle dipper 56 with the recycle feed hole 62 as situated on the conduit 52.

In operation, raw feed material is introduced from the feed bin 24 into the essentially oxygen free gasifying chamber 12 of the rotary kiln 10. As the material enters the receiving end 18, it immediately begins receiving heat from the radiant tubes 36. The feed material heats to the pyrolysis temperature, generally in the range of from 1000° F. to 1600° F., and begins to decompose as heat is continually added. During this pyrolysis, three primary products are formed: char, which is composed of fixed carbon, ash and moisture; product gas; and tar, which is condensed from the product gas as it is cooled. When higher temperatures are used, the char and tar fractions are decreased, and the gas fractions are increased. Lower temperatures normally produce greater amounts of solids and liquids.

The volume of decomposing material quickly reduces as the conversion to gas proceeds, with the remainder of the material moving toward the outlet end 20 of the gasifying chamber 12 as a function of the feed rate and the inclination of the kiln 10. Although the kiln 10 as illustrated has a horizontally extending longitudinal axis, a slight inclination may aid the efficiency of the kiln 10 by increasing the feed rate. As the product moves, it sees progressively higher temperatures from the radiant tubes 36. The feed material moves in a counterflow relationship with the hot gases in the radiant tubes 36. This counterflow design produces a high temperature char at the outlet end 20, while producing a low temperature exhaust from the combusted gas in the radiant tubes 36 at the receiving end 18, conserving the valuable energy in the combusted gas. Conventional lifters (not shown) are attached to the inner wall 16 of the gasifying chamber 12, and run longitudinally between the radiant tubes 36. The combination of lifters and radiant tubes 36 provides a method to physically raise the feed and produce a raining environment within the chamber 12. This environment permits efficient radiant heat transfer between the radiant tubes 36 and each individual particle of the feed material.

The carbon content of the char will depend upon the residence time, the reactor temperature and the water content in the product gas. The preferred exit temperature of the gasifier is in the range of 1500° F. to 1600° F. The residence time is controllable by adjusting the reactor inclination and the speed of the rotating kiln 10. In order to further control the residence time of the solid char and to introduce the hot char into the most concentrated steam environment, the recycle system transfers a portion of the char through the recycle conduit 52 by means of the recycle auger 54 to the receiving end 18 of the gasifying chamber 12. This char recycle system is especially advantageous in that it aids in rapidly heating the incoming feed by transferring heat from the hot char to the feed, thus requiring less heat input; shortens the length of time needed for initially heating the feed; increases the temperature of the feed; conserves valuable product gas; and permits more of the char to be converted to carbon monoxide and hydrogen.

The hot char is recycled to the receiving end 18 where the drying of the feed material occurs and the highest concentration of water vapor exists. The high water vapor concentration aids in the steam/char reaction converting carbon to hydrogen and carbon monoxide:

$$C+H_2O=H_2+CO$$

The hot char mixes intermittently with the raw feed material to thereby provide excellent heat transfer. The recycled char residence time is thus doubled, increasing the conversion of char to product gas.

The concentration of ash is also increased by the recycle system 50, and because ash acts as a catalyst in the production of gas, the amount of gas produced is also increased. Furthermore, if an additional catalyst is used, the catalyst residence time is increased and the catalyst requirement is reduced. The ash generally produced consists of oxides such as $KO_2$, $Fe_2O_3$, $CaO_2$, $Al_2O_3$ and, most commonly, $SiO_2$.

The cold gas efficiency of the gasifier, which is the stored energy in the cold product gas divided by the stored energy in the raw feed material, is directly influenced by the amount of char in the outlet end 20. Less char means higher cold gas efficiency, which directly affects the overall cycle efficiency of the gasifier. To further assist in the cold gas efficiency, the recycle fan 64 is mounted in the exit end of the recycle conduit 52. The fan 64 is driven by the drive shaft 66 mounted within the gas pipe 28, and the fan 64 recycles hot product gas from the outlet end 20 to the receiving end 18 of the gasifying chamber 12. This recycled gas stream aids in heating the incoming feed material by transferring heat to it, and also aids in the steam/char reaction by producing increased water vapor in the receiving end 18 where the drying process occurs. The fan speed is preferably controllable to adjust the amount of gas recycled in this system.

The large amount of carbon monoxide produced in this manner reacts with water vapor to produce larger hydrogen and carbon dioxide concentrations. This reaction is known as the water/gas shift:

$$H_2O+CO=CO_2+H_2$$

and is followed by another important reaction:

$$CO_2+C=2CO$$

The residence time of the tar is also increased by the recycle system 50, especially the gas recycle, and thus more tar is decomposed to increase the formation of product gas.

In summary, the recycling of the char and the gas increases the efficiency of the gasifier by providing more efficient heat transfer. Furthermore, both recycling processes increase the ultimate formation of product gas.

The conical configuration of the rotary kiln 10, as seen in FIG. 1*a*, produces further advantageous results. The cone shape permits a maximum feed rate of the raw material into the receiving end 18 of the gasifying chamber 12. Since the heat energy from the radiant tubes 36 radiates from the tubes 36 at right angles, the convergence of the tubes focuses the radiation toward the receiving end 18 where the heat load of the raw material is presented. The efficiency of the gasifier is thus increased as the feed material is heated more rapidly. The convergence also results in reduced spacing between the radiant tubes 36 adjacent the outlet end 20 of the gasifying chamber 12, further intensifying the heat energy on the feed material to increase efficiency.

In test runs of a pilot plant embodying the invention, a variety of feed stocks used included wood, rubber, sewage sludge, refuse derived fuel, and blended mixtures of two or more of these feed types. In one particular test run, 300 lb/hr of pine sawdust was fed into the kiln for more than eight hours. The operating temperatures ranged from 1530° F. to 1600° F. The cold gas efficiency, which is the stored energy in the cold gas produced divided by the stored energy in the feed material, was 70%. Approximately 40% of the product gas was used to operate the burners in the self-sustaining mode. The gas composition (by volume %) produced ranged as follows: methane 16.69–16.93%; carbon monoxide 40.68–41.80%; hydrogen 24.17–26.68%; carbon dioxide 11.09–11.45%; $C_2$ gases 4.50–4.74%; and $C_3$ gases 0.12–1.25%. The kiln produced 465–490 Btu/SCF gas. The moisture content of the feed material was 10%, while the moisture content of the char was 1%. The feed had an ash content of 0.56%, the char ash content was 4.2%, and the tar ash content was 0.7%. The char was produced at a rate of 37 lb/hr, and the tar rate was 2 lb/hr.

It is to be understood that while certain forms of this invention have been illustrated and described, it is not limited thereto, except insofar as such limitations are included in the following claims.

Having thus described the invention, what is claimed as new and desired to be secured by Letters Patent is:

1. A gasifier for converting an organic solid feed material to a product gas, said gasifier comprising:

a rotary kiln for providing an essentially oxygen-free gasifying chamber, and having a generally horizontally extending longitudinal axis, an outer wall means radially spaced from said axis and defining said chamber therewithin, a receiving end and an opposing outlet end;

means for feeding an organic solid feed material to said kiln into said receiving end thereof;

radiant heating means in said chamber radially spaced from said axis, and extending longitudinally of the gasifying chamber for transferring heat to the feed material to pyrolyze the material and convert it to char, a highly catalytic ash, and a product gas as the material advances toward said outlet end;

conduit structure in said chamber extending from said outlet end to said receiving end for recycling a portion of the char and ash and thereby augmenting the heating of an incoming feed material, magnifying the percent of highly catalytic components in the ash, and extending the residence time to thereby improve gasification;

means adjacent said outlet end for loading the portion of the char and ash into said conduit structure in response to rotation of said kiln;

means at said outlet and for unloading the remainder of the char and ash and discharging the product gas from the kiln; and fan means in said conduit structure for drawing a portion of the product gas from said outlet end through said structure to said receiving end to augment the recycling of the char and ash and the heating of incoming feed material, thereby improving gasification efficiency.

2. A gasifier for converting an organic solid feed material to a product gas, said gasifier comprising:

a rotary kiln for providing an essentially oxygen-free gasifying chamber, and having a generally horizontally extending longitudinal axis, an outer wall means radially spaced from said axis and defining said chamber therewithin, a receiving end and an opposing outlet end;

means for feeding an organic solid feed material to said kiln into said receiving end thereof;

radiant heating means in said chamber radially spaced from said axis, and extending longitudinally of the gasifying chamber for transferring heat to the feed material to pyrolyze the material and convert it to char, a highly catalytic ash, and a product gas as the material advances toward said outlet end;

conduit structure in said chamber extending from said outlet end to said receiving end for recycling a portion of the char and ash and thereby augmenting the heating of an incoming feed material, magnifying the percent of highly catalytic components in the ash, and extending the residence time to thereby improve gasification;

means adjacent said outlet end for loading the portion of the char and ash into said conduit structure in response to rotation of said kiln;

means at said outlet end for unloading the remainder of the char and ash and discharging the product gas from the kiln; and said outer wall of said kiln being of generally conical configuration to provide said chamber with a progressively smaller cross-sectional area as said outlet end is approached, said radiant heating means including a plurality of circumferentially spaced, radiant tubes extending generally parallel to said wall and converging as said outlet end is approached, whereby to focus the radiant energy toward a heat load of advancing feed material.

3. A gasifier for converting an organic solid feed material to a product gas, said gasifier comprising:

a rotary kiln for providing an essentially oxygen-free gasifying chamber, and having a generally horizontally extending longitudinal axis, an outer wall radially spaced from said axis and defining said chamber therewithin, a receiving end and an opposing outlet end;

said outer wall of said kiln being of generally conical configuration to provide said chamber with a progressively smaller cross-sectional area as said outlet end is approached;

means for feeding an organic solid feed material to said kiln into said receiving end thereof;

radiant heating means in said chamber radially spaced from said axis, and extending longitudinally of the gasifying chamber for transferring heat to the feed material to pyrolyze the material and convert it to char, ash and a product gas as the material advances toward said outlet end;

said radiant heating means including a plurality of circumferentially spaced, radiant tubes extending generally parallel to said wall and converging as said outlet end is approached, whereby to focus the radiant energy toward a heat load of advancing feed material; and means at said outlet end for unloading the remainder of the char and ash and discharging the product gas from said kiln.

* * * * *

UNITED STATES PATENT AND TRADEMARK OFFICE

CERTIFICATE OF CORRECTION

PATENT NO. : 4,881,947

DATED : November 21, 1989

INVENTOR(S) : Thomas H. Parker; Virgil J. Flanigan

It is certified that error appears in the above—identified patent and that said Letters Patent is hereby corrected as shown below:

In claim 1, column 8, line 22, delete "and" and substitute --end-- therein.

Signed and Sealed this

Thirtieth Day of October, 1990

*Attest:*

HARRY F. MANBECK, JR.

*Attesting Officer*

*Commissioner of Patents and Trademarks*